US011885046B2

(12) United States Patent
Laune et al.

(10) Patent No.: US 11,885,046 B2
(45) Date of Patent: Jan. 30, 2024

(54) WEB STRETCHING DEVICE DISPOSED BETWEEN A CARDING DEVICE AND A CROSS-LAPPER

(71) Applicant: ANDRITZ ASSELIN THIBEAU, Elbeuf (FR)

(72) Inventors: Jean-Christophe Laune, La Londe (FR); Hugues Leroy, Rouen (FR); Frédéric Noelle, Saint-Nazaire-les-Eymes (FR)

(73) Assignee: Andritz Asselin Thibeau, Elbeuf (FR)

( * ) Notice: Subject to any disclaimer, the term of this patent is extended or adjusted under 35 U.S.C. 154(b) by 19 days.

(21) Appl. No.: 16/348,228

(22) PCT Filed: Nov. 14, 2017

(86) PCT No.: PCT/EP2017/079227
§ 371 (c)(1),
(2) Date: May 8, 2019

(87) PCT Pub. No.: WO2018/095766
PCT Pub. Date: May 31, 2018

(65) Prior Publication Data

US 2019/0271102 A1 Sep. 5, 2019

(30) Foreign Application Priority Data

Nov. 25, 2016 (FR) ..... 16 70710
Oct. 31, 2017 (FR) ..... 17 71155

(51) Int. Cl.
*D01G 15/46* (2006.01)
*D01G 21/00* (2006.01)
(Continued)

(52) U.S. Cl.
CPC ..... *D01G 15/46* (2013.01); *D01G 21/00* (2013.01); *D01G 23/08* (2013.01); *D01G 25/00* (2013.01); *D04H 1/74* (2013.01)

(58) Field of Classification Search
CPC ..... D01G 15/46; D01G 21/00; D01G 23/08; D01G 25/00; D04H 1/74
(Continued)

(56) References Cited

U.S. PATENT DOCUMENTS 4,461,058 A * 7/1984 Gaudino ..... D01H 5/22 19/258
5,590,442 A * 1/1997 Hirschek ..... D01G 25/00 19/163
(Continued)

FOREIGN PATENT DOCUMENTS

DE 20113467 U1 12/2002 ..... D01G 23/00
DE 10356074 A1 * 6/2005 ..... D01G 25/00
(Continued)

OTHER PUBLICATIONS

International Search Report dated Jun. 5, 2018 in related application No. PCT/EP2014/079227.
(Continued)

*Primary Examiner* — Aiying Zhao
(74) *Attorney, Agent, or Firm* — Renner, Kenner, Greive, Bobak, Taylor & Weber

(57) ABSTRACT

Apparatus for forming a fibre mat, in particular a non-woven mat, comprising a fibre web-forming device, for example a card, a cross-tapper and a device for drafting the fibre web(s) disposed between the web forming device and the cross-lapper in order to draft the fibre web(s), in particular in a time-varying, specifically periodic manner, to thereby adjust a predetermined desired profile of the fibre mat leaving the cross-lapper, the web-forming device comprising at least
(Continued)

one output belt (1, 2) for at least one web (5, 6), and preferably two output belts (1, 2) for two webs (5, 6), an upper and lower web respectively; wherein the cross-hipper has an input belt (7) for receiving the web(s) from the output belt(s) of the web forming device, characterised in that the arrangement is such that the path of the web, or of the at least one web, and preferably of the two, upper and lower, webs, between the output belt(s) of the web-forming device, in particular the card, and the input belt of the cross-lapper includes at least one inflection point (11, 12).

1 Claim, 2 Drawing Sheets

(51) Int. Cl.
*D01G 23/08* (2006.01)
*D01G 25/00* (2006.01)
*D04H 1/74* (2006.01)

(58) Field of Classification Search
USPC ..... 19/98, 106 R, 236, 258, 260, 263, 267, 19/296
See application file for complete search history.

(56) References Cited

U.S. PATENT DOCUMENTS

| | | | | |
|---|---|---|---|---|
| 6,362,167 | B1 | 3/2002 | Ghosal | 514/25 |
| 2003/0033691 | A1* | 2/2003 | Bernhardt | D04H 1/74 19/105 |
| 2003/0061686 | A1* | 4/2003 | Collotte | D01G 15/465 19/308 |

FOREIGN PATENT DOCUMENTS

| | | | | |
|---|---|---|---|---|
| EP | 2 085 504 | A1 | 5/2009 | D01G 15/46 |
| WO | WO-2004013390 | A1 * | 2/2004 | D04H 1/732 |

OTHER PUBLICATIONS

Written Opinion dated Jun. 5, 2018 in related application No. PCT/EP2017/079227.

* cited by examiner

WEB STRETCHING DEVICE DISPOSED BETWEEN A CARDING DEVICE AND A CROSS-LAPPER

CROSS-REFERENCE TO RELATED APPLICATION

This is a § 371 application of International patent application number PCT/EP2017/079227 filed Nov. 14, 2017, and French application numbers FR 17 71155 filed Oct. 31, 2017 and FR 16 70710 filed Nov. 25, 2016.

TECHNICAL FIELD

The present invention refers to an apparatus for forming a fibre mat comprising at least one web-forming device for forming at least one web, in particular a card and a cross-lapper, a device for drafting at least one web being disposed between the device for forming at least one web, in particular the card and the cross-lapper, the purpose of the drafting being to control the area density (g/m$^2$) distribution profile or the thickness of the mat leaving the cross-lapper.

BACKGROUND ART

This drafting device well-known from prior art presents several problems.

Firstly, the result of pinching the web leaving the card before entering the cross-lapper at two points is to mark the web entering the cross-lapper, thereby creating non-homogeneities in the web that impair the quality of the mat as it leaves the cross-lapper.

Secondly, the result of pinching the web is to expel the air in the web exiting the card at the pinch point. Now this air, expelled from the web by the pinch points, adversely affects the transportation of the card web, for example by causing it to be detached from its conveyor belt and/or by creating local folds. This results either in a web of poor quality, or in the need to provide complicated systems to evacuate the air and/or cancel out the effects of the air on transportation of the card web.

The present invention aims to overcome the problems of the prior art by proposing an apparatus for forming a fibre mat, in particular non-woven, comprising a device for the production of fibre web(s), for example a card, a cross-lapper and a drafting device for fibre webs disposed between the web(s) production device and the cross-lapper, that permits drafting, in particular with time variance, in particular periodic, of the fibre web(s) thereby adjusting the given desired profile before the fibre mat leaves the cross-lapper, in particular a truly homogeneous mat, in particular having a uniform or quasi-uniform transverse thickness profile and/or area density, without the need to pinch the web(s), so as to produce a better quality mat leaving the cross-lapper, in particular without any damaged point or area, as may be the case in the prior art due to the pinching and, in particular, without the need to provided complicated devices to evacuate the air in the apparatus.

SUMMARY OF THE INVENTION

According to a first aspect of the invention, a fibre mat-forming apparatus, in particular non-woven, is as defined in claim 1, improvements being defined in the sub-claims.

By thereby providing a sort of feeding of the web moving between the web-forming device output belt and the cross-lapper input belt combined with the drafting, the quality of the drafting produced is greatly improved, for example by an intermediate drafting roller, the drafting tension combined with the feeding improving the adhesion of the web, while at the same time avoiding pinching the web because of the feeding and therefore marking the non-woven web in any way at all, which contributes to an improvement in the quality of the mat leaving the cross-lapper. The advantage of holding by adhesion together with the drafting-feeding combination compared with pinching, is that the long fibres disposed in general in the direction of flow of the web, retain some relative freedom of movement permitting more progressive application of drafting thereby limiting marking of the product.

In addition, as it is not pinched, or subjected to the slightest pressure, or possibly a low pressure perpendicular to the web(s) between the cross-lapper and the output belt of the web-forming device, air is not expelled from the web or webs circulating between the web-forming device and the cross-lapper, so that either the formation of folds created by detachment by the air expelled from the web from its conveyor belt is avoided, or it is not necessary to provide a device to evacuate the air to counter this detachment.

According to a preferred method of realisation, the drafting system comprises a roller, part of whose outer surface transports the web or webs between the output belt and the input belt, the roller being driven by a rotary drive mechanism in such a way that its rotational speed can be varied as a function of the drafting that it is desired to impart to the web (s).

According to a preferred method of realisation, two web output belts are provided, in particular card belts, upper and lower respectively, the upper and lower webs rejoining at the drafting roller.

In particular, the output belt(s) is inclined with respect to the cross-lapper input belt.

In particular, the output end point of the output belt(s) is offset in height, in particular above, with respect to the input end point of the cross-lapper belt.

According to one method of realisation, at the output of the guide roller of the upper belt, the upper web comes into contact with the outer surface of the drafting roller and moves along this outer surface up to the guide roller of the cross-lapper input belt.

Preferably, the drafting system consists in moving the output belt at a constant or substantially constant speed, while the peripheral speed of the drafting roller is controlled so that the latter drives the card web at a greater speed than that of the web I the card and varies as a function of the drafting it is desired to impart to the web(s).

According to one method of realisation, the cross-tapper input belt moves at the same speed as the periphery of the drafting roller.

According to another advantageous method of realisation, the cross-lapper input belt drives the card web at a slightly higher speed than that of the drafting roller, for example 1% to 10% higher, this drafting (difference in speeds) between the drafting roller and the input of the lapping fibre being preferably constant, and thus independent of the variable drafting applied between the output from the card and the drafting roller.

According to a second aspect of the invention, independent of the first aspect above, and which can be implemented independently of the first aspect, but also in combination with it, a fibre web-forming apparatus, comprising a mat-forming device, for example a card, for the formation of at least one fibre web and one cross-lapper supplied in the at least one web to produce lapping by the to-and-fro movement of a fibre lapper carriage with a view to obtaining a fibre mat consisting of a stack of sections of the at least one fibre web transverse to each other, a device for drafting the fibre webs being disposed between the output from the web-forming device and the input of the cross-lapper preferably with time-varying drafting, in particular periodic, to control the transverse thickness profile and/or the weight of the fibre mat obtained as it leaves the cross-lapper, is characterised in that the drafting device comprises a drive component for at least one web, in particular a drafting roller, disposed between the web-forming device and the cross-lapper, the drive component comprising a driving surface intended to come into contact with the at least one web to drive it, and in that it is fitted with a suction device to produce suction at the driving surface to hold the at least one web against the driving surface by suction.

By arranging to apply a suction force here holding the web against the driving surface, the web or webs is/are assured to be well guided and held while being driven, without risking either damage by pinching or tightening, which would have the effect of pressing on it or them to the point of sometimes piercing it or them, in particular downstream pinching, close to the cross-lapper, in the case of double pinching. The fibre mat leaving the cross-lapper is of better quality, in particular without pierced and/or damaged areas and in addition the transverse thickness and/or weight profile of the mat is closer to that expected owing to the variable drafting carried out on at least web, perhaps corresponding perfectly, or almost perfectly to it.

In particular, the advantage of holding by adhesion together with a combination of drafting and suction/negative pressure, compared with double pinching as in the prior art, is that the long fibres disposed in general in the direction of flow of the web, retain some relative freedom of movement permitting more progressive application of drafting which limits marking of the web or webs and the mat.

According to a particularly preferred method of realisation, the drive component is a so-called drafting roller, part of whose outer surface constitutes the driving surface transporting the web or webs between the output belt or belts and the input belt, the roller being controlled by a rotary drive mechanism whose speed of rotation varies as a function of the drafting that it is desired to impart to the web, the letter itself being dependent on the transverse profile it is desired to obtain.

In particular, the use of a drafting roller permits high accuracy in the region of application of suction to the fibre web(s).

According to an improvement, to improve the conveyance, in particular the guidance, of the web between the card output belt and the cross-lapper input belt, the drafting roller is covered with a sleeve in a material giving good adhesion to the web(s).

According to a preferred method of realisation, the suction device is arranged so that the thickness of the web(s) passing over the drive surface is not less than 50% of the thickness of the web directly upstream of the roller and preferably not less than 75% of its/their thickness directly upstream of the drive component, preferably not less than 90%, and more preferably substantially equal to its thickness directly upstream of the drive component and even more preferably substantially equal to its/their thickness directly upstream of the drive component, in particular the suction device being arranged to create, for a total area density of the web or webs of between 20 and 100 g/m$^2$, and in particular between 30 and 80 g/m$^2$, a negative pressure of between 10 millibars and 100 millibars, and in particular between 40 and 70 millibars.

Preferably, the drafting roller is positioned downstream of a guide roller for each output belt to limit the distance over which the drafting force between the guide roller of the respective belt and the drafting roller is applied.

According to a preferred method of realisation, two output belts from the web-forming device, in particular the card, are provided, upper and lower respectively, and two upper and lower webs coming together at the input to the drive component.

Preferably, the linear peripheral (tangential) speed of the drive component varies over a speed range of between 100 and 150% of the speed of the output belt or belts from the web forming device, in particular a card, and preferably between 100 and 140%.

Preferably, the speed of the cross-lapper input belt is substantially equal or equal to the peripheral speed of the drive component.

Even more preferably, the cross-lapper input belt drives the card web at a speed slightly higher than that of the drive component, for example 1 to 10% greater, the drafting preferably being constant and thus independent of the variable drafting applied by the drive component.

Preferably, the drafting roller is disposed at a distance from the guide roller of each belt, preferably at the most 1 meter from the roller or from each guide roller and, in particular, at a distance of between 50 mm and 300 mm.

Preferably, the space between the output belt guide roller or the upper output belt of the web-forming device and the drafting roller is between 5 and 20 mm, and preferably between 7 and 15 mm, for a web area density of between 10 and 50 g/m$^2$, and preferably between 20 and 40 g/m$^2$.

Preferably, the space between the guide roller of the second, or lower, output belt, and the drive component is between 10 and 30 mm, and preferably between 15 and 25 mm, for a web area density of between 10 and 50 g/m$^2$, and preferably between 20 and 40 g/m$^2$.

The present invention also refers to a process for producing a fibre web with an apparatus comprising a web-forming device and a cross-lapper, in which:

- at least one fibre web is routed between the output of the web-forming device and the cross-lapper by passing it over a drive surface, in particular the surface of a roller,
- the at least one web is held against the drive surface by suction; and
- the web held against the surface is stretched.

BRIEF DESCRIPTION OF THE DRAWINGS

As an example, preferred methods of realisation of the invention are described with reference to drawings in which.

BEST MODE FOR CARRYING OUT THE INVENTION

Figure 1:
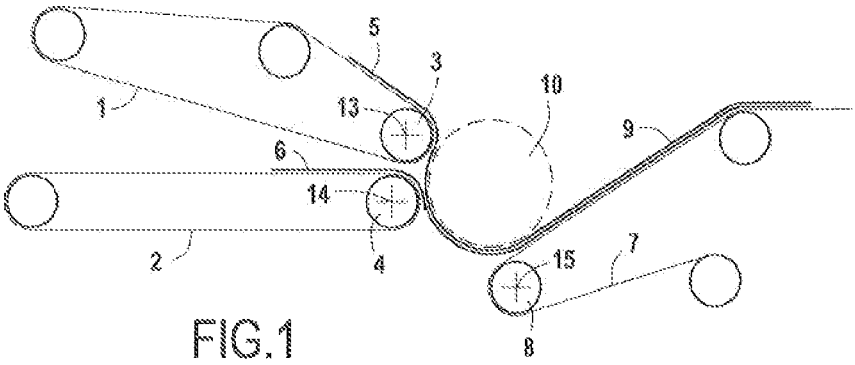
FIG. 1 is a diagram of an apparatus according to one method of realisation of the invention.

In FIG. 1, a card produces two non-woven webs 5 and 6 leaving the card on two card output belts 1 and 2, upper and lower respectively. The upper and lower card output belts 1 and 2 each comprise respective guide rollers 3 and 4 rotating at substantially identical and constant speed. The two webs 5 and 6 leaving the two card output belts 1 and 2 are directed towards the input belt 7 of a cross-tapper which itself has a guide roller 8.

The web 9 formed by the meeting of the two webs 5 and 6 is then processed in the cross-lapper, and in particular unfolded in the form of sections transverse to each other to form a non-woven mat as it leaves the cross-lapper.

Between the two card output belts 1 and 2 and the input belt 7 of the cross-lapper, the two webs are transported by a drafting roller 10 driven by a motor controlled by a control system to change the speed of rotation of the drafting roller 10 to stretch the card web more or less as required and, in particular, to adjust the transverse thickness profile of the mat formed at the output of the cross-lapper.

The guide rollers 3 and 4 of the two card belts rotate substantially at the same, in particular constant speed, while the drafting roller 10 rotates at a time-varying peripheral speed, in particular periodic, greater than that of card leaves belts 1 and 2, thereby drafting the webs 5 and 6. The input belt 7 advances at a speed substantially equal to that of the drafting roller 10. However, slight drafting can also be applied (in particular from 1 to 10%) between the roller 10 and the input belt 7, the tension induced by this auxiliary drafting increasing the adhesion of the web to the roller 10.

The path of the upper web 5 between the upper exit belt 1 and the cross-lapper input belt 7 is such that it passes over a part of the outer surface of roller 10. In addition, it is arranged so that an inflection point is formed between the output roller 3 of belt 1 and the cross-lapper input roller 8 of belt 7.

In the same way, an inflection point is formed for the lower web 6 leaving the lower output belt 2, between the output roller 4 of the output belt 2 and the input roller 8 of the cross-lapper input belt. However, according to another method of realization, only a single inflection point may be provided for the upper web 5, but not for the lower web 6.

According to another possible method of realisation, the system can also be improved by arranging that roller 10 employs suction to assist guidance of the two webs 5 and 6 between rollers 3 and 4 and the input belt 7.

As can be seen in FIG. 1, each of the output belts 1 and 2 is inclined with respect to the cross-lapper input belt 7. The output end point of each of the belts 4 and 5 is offset in height with respect to, in particular above, the end input point of the cross-lapper input belt 8. The end, or guide, rollers 3 and 4 of each output belt, in particular their respective shafts 13 and 14, are offset in height with respect to, in particular above, the end, or guide roller 8 of the cross-lapper, in particular with respect to its shaft 15.

On leaving roller 3, the upper web 5 comes into contact with the outer surface of roller 10 and is moved along this outer surface up to the cross-lapper input belt 8.

On leaving roller 4, the web 6 comes into contact with the upper web 5, itself in contact with the outer surface of roller 10 and is moved with web 5 along this outer surface up to the cross-lapper input belt 8.

The space between roller 10 and roller 3 is greater than the sum of the thicknesses of the belt 1 and the web 5, so that no pinching force is applied to web 5 in this space. In particular, this space may be between 5 and 20 mm, for example between 7 and 15 mm, for a web area density of between 10 and 50 g/m$^2$, and preferably between 20 and 40 g/m$^2$.

The space between roller 10 and roller 4 is greater than the sum of the thicknesses of the belt 2, web 5 and web 6, so that no pinching force is applied to the two webs 5 and 6 in this space. In particular, this space may be between 10 and 30 mm, for example between 15 and 25 mm, to give a web area density of between 10 and 50 g/m$^2$, and preferably between 20 and 40 g/m$^2$.

The space between roller 10 and roller 8 is greater than the sum of the thicknesses of belt 7 and the web 9, so that no pinching force is applied to the web 9 in this space.

Figure 2:
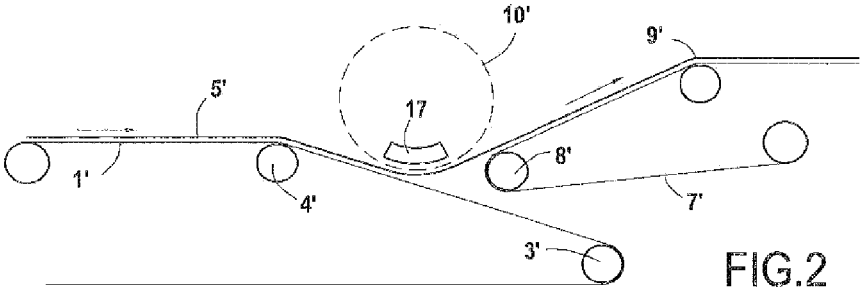
FIG. 2 shows diagrammatically an apparatus according to another method of realisation of the invention.
Figure 4:
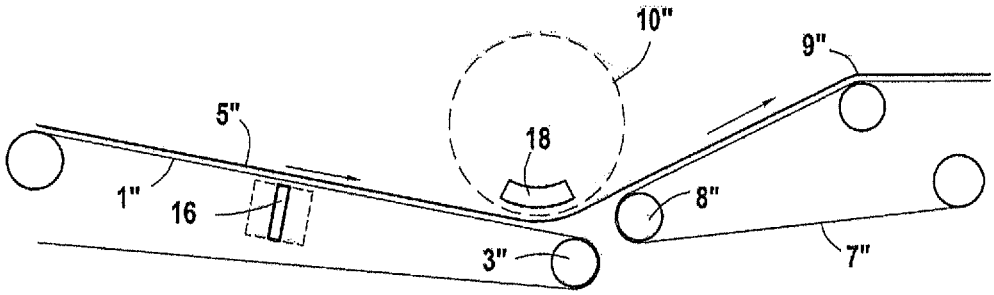
FIG. 4 shows diagrammatically an apparatus according to a third method of realisation of the invention.
Figure 5:
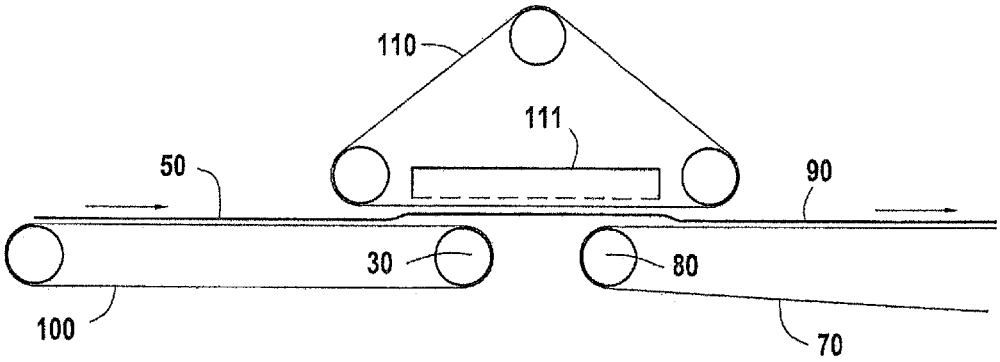
FIG. 5 shows diagrammatically an apparatus according to a fourth method of realisation of the invention.

According to the method of realisation shown in FIGS. 1, 2 and 4, a drafting device in the form of a cylindrical roller has been provided. However, a component of any other shape could be provided, it being important that a driving surface in contact with the web 5 is formed to route it between roller 3 and roller 8 while drafting the web 5. For example, an endless belt could be provided as shown in FIG. 5, having a straight portion extending between the two rollers 3 and 8.

The portion of belt 1 before the guide roller 3 is inclined downwards in the direction of roller 3, while the portion of belt 7 is inclined in the other direction, that is to say upwards from the guide roller 8.

The portion of belt 2 before the guide roller 4 is substantially horizontal.

FIG. 2 shows another method of realisation of an apparatus according to the invention. Components having the same function as in FIG. 1 are designated by the same numerical reference with the sign'.

A card produces a non-woven fibre web 5' leaving the card on a card output belt 1'. The card output belt 1' includes a guide roller 3' rotating at a substantially constant speed. The web 5' leaving the card is routed towards a cross-lapper input belt 7' which itself has a guide roller 8'.

The web 5' is then processed in the cross-lapper, and in particular laid out in the form of sections transverse to each other to form a non-woven mat at the output of the cross-lapper.

Between the card output belt 1' and the cross-lapper input belt 7', the web is transported by a drafting roller 10' driven by a motor controlled by a control system to change the speed of rotation of the drafting roller 10' to stretch the card web more or less as required, and in particular to adjust the transverse thickness profile of the fibre web formed at the output of the cross-lapper.

The card belt guide roller 3' rotates at a substantially constant speed, while the drafting roller 10' has a peripheral speed that is time-varying, in particular periodic, and higher than that of card output belt 1', thereby drafting the web 5', the stretched web entering the cross-lapper reference 9' in FIG. 2. The input belt 7' advances at a speed substantially equal to that of the drafting roller 10'. However, a slight drafting can also be applied (in particular from 1 to 10%) between roller 10' and the input belt 7', the tension induced by this auxiliary drafting improving control of the web during transfer from roller 10' to belt 7'.

The path of the web 5' between the upper output belt 1' and the cross-lapper input belt 7' is such that it passes over a part of the lower surface of roller 10', in particular over a sector with an angle of between 60° and 100°.

Roller 10' employs suction to assist guidance of the web 5' between roller 4' and the input belt 7' and hold it against the surface of roller 10' during drafting. To do this, a suction sector 17 connected to a fan (not shown) creates a negative pressure inside roller 10' to produce the negative pressure necessary to hold the web 5' against the lower surface of the roller 10'. The suction sector 17 and its associated fan are arranged so that the thickness of the web 5' passing over the surface of roller 10' is not less than 50% of the thickness of web 5' directly upstream of the roller and preferably not less than 75% of its thickness directly upstream of the roller, and preferably not less than 90%, and even more preferably substantially equal to the thickness directly upstream of the roller and still more preferably, equal to its thickness directly upstream of roller 10'. In particular the suction sector 17 and its associated fan are dimensioned to create, for a web area density of between 20 and 100 g/m$^2$, in particular between 40 and 80 g/m$^2$, a negative pressure of between 10 millibars and 100 millibars, and in particular between 40 and 70 millibars.

On leaving roller 4', the web 5' comes into contact with the lower surface of roller 10' and is moved along this surface towards the cross-lapper input belt 7'.

The space between roller 10' and the belt 1' is greater than the thickness of the web 5', so that no pinching force is applied to the web 5' in this space. In particular, this space may be between 5 and 20 mm, for example between 7 and 15 mm giving a web area density of between 10 and 50 g/m$^2$, and preferably between 20 and 40 g/m$^2$.

The space between roller 10' and roller 8' is greater than the thickness of the web 9', so that no pinching force is applied to the web 9' in this space.

FIG. 4 shows a third method of realisation of an apparatus according to the invention. Components with the same function as in FIG. 1 are designated here by the same numerical reference with the sign".

A card produces a non-woven fibre web 5" leaving the card on a card output belt 1". The card output belt 1" includes a guide roller 3" rotating at a substantially constant speed. The web 5" leaving the card is routed towards input belt 7" of a cross-lapper which itself has a guide roller 8".

The web 5" is then processed in the cross-lapper, and in particular laid out in the form of sections transverse to each other to form a non-woven mat at the output of the cross-tapper.

Between the card output belt 1" and the input belt 7" of the cross-lapper, the web is transported by a drafting roller 10" driven round by a motor controlled by a control system that varies the speed of rotation of the drafting roller 10" to stretch the web more or less as required, and in particular to adjust the transverse thickness profile of the mat formed at the output of the cross-lapper.

The guide roller 3" of the card belt rotates at a substantially constant speed, while the drafting roller 10" rotates at a peripheral speed that is time-varying, in particular periodic, and greater than that of the card output belt 1" thereby drafting the web 5", the stretched web entering the cross-tapper reference 9" in FIG. 4. The input belt 7" advances at a speed substantially equal to that of the drafting roller 10". However, slight drafting can also be applied (in particular from 1 to 10%) between the roller 10" and the input belt 7", the tension induced by this auxiliary drafting improving control of the web during its transfer from roller 10" to the belt 7".

The path of the web 5" between the upper output belt 1" and the cross-tapper input belt 7" is such that it passes over a part of the lower surface of roller 10", in particular over a sector with an angle of between 60° and 100°.

Roller 10" employs suction to assist in guidance of the web 5" between input belts 1" and belt 7' and hold it against the surface of roller 10" during drafting. To do this, a suction sector 18 together with a fan (not shown) produces a negative pressure inside the roller 10" to obtain the negative pressure necessary to hold the web 5" against the lower surface of roller 10". The suction sector 18 and its associated fan are dimensioned so that the thickness of the web 5" passing over the surface of roller 10" is not less than 50% of the thickness of the web 5" directly upstream of the roller, and preferably not less than 75% of its thickness directly upstream of the roller, and preferably not less than 90%, and even more preferably substantially equal to the thickness directly upstream of the roller and still more preferably equal to its thickness directly upstream of roller 10", in particular the suction sector 18 and its associated fan are dimensioned to create, for a web area density of between 20 and 100 g/m$^2$, and in particular between 30 and 80 g/m$^2$, a negative pressure of between 10 millibars and 100 millibars, and in particular between 40 and 70 millibars.

As it leaves belt 1", the web 5" comes into contact with the lower surface of roller 10" and is moved along this surface towards the cross-lapper input belt 7".

The space between roller 10" and the belt 1" is greater than the thickness of the web 5", so that no pinching force is applied to the web 5" in this space. In particular, this space may be between 5 and 20 mm, for example between 7 and 15 mm giving a web area density of between 10 and 50 g/m$^2$, and preferably between 20 and 40 g/m$^2$.

The space between roller 10" and roller 8" is greater than the thickness of the web 9", so that no pinching force is applied to the web 9" in this space.

A suction chamber 16 together with a fan (not shown) is also disposed near belt 1" to provide auxiliary holding of the web 5" by suction against a part of the upper surface of the belt 1". The suction chamber 16 is arranged so that the thickness of the web 5" downstream of the fan is not less than 50% of the thickness of the web 5" directly upstream of the chamber 16, and preferably not less than 75% of its thickness directly upstream of the chamber 16, and preferably not less than 90%, and more preferably substantially equal to the thickness directly upstream of the chamber 16 and still more preferably equal to its thickness directly upstream of the chamber 16. In particular the suction chamber 16 and its associated fan are dimensioned to create, for an area density of the web 5" of between 20 and 100 g/m$^2$, in particular between 30 and 80 g/m$^2$, a negative pressure of between 10 millibars and 100 millibars, and in particular between 40 and 70 millibars.

FIG. 5 shows a fourth method of realisation of an apparatus according to the invention.

A card produces a non-woven fibre web 50 leaving the card on a card output belt 100. The card output belt 100 comprises a guide roller 30 rotating at a substantially constant speed. The web 50 leaving the card is routed towards a cross-lapper input belt 70 which itself has a guide roller 80.

The web 50 is then processed in the cross-lapper, and in particular laid out in the form of sections transverse to each other to form a non-woven mat at the output of the cross-lapper.

Between the card output belt 100 and the cross-lapper input belt 70, the web is transported by an endless belt 110 driven by a motor controlled by a control system that varies the speed of the endless belt 110 to stretch the card web more or less as required, and in particular to adjust the transverse thickness profile of the mat formed at the output of the cross-lapper.

The card belt guide roller 30 rotates at a substantially constant speed, while the endless belt 110 has a speed that is time-varying, in particular periodic, and higher than that of the card output belt 100, thereby drafting the web 50, the stretched web entering the cross-lapper bearing reference 90 in FIG. 5. The input belt 70 advances at a speed substantially equal to that of the endless belt 110. However, slight drafting can also be applied (in particular from 1 to 10%) between the endless belt 110 and the input belt 70, the tension induced by this auxiliary drafting improving control of the web during its transfer from the endless belt 110 to belt 70.

The path of the web between the upper output belt 100 and the cross-lapper input belt 70 is such that it passes over a part of the lower surface of the endless belt 110.

The endless belt 110 employs suction to assist in guidance of the web between the belt 100 and the input belt 70 and hold it against the surface of belt 110 during drafting. To do this, a suction chamber 111 together with a fan (not shown) produces a negative pressure inside the endless belt 110 to obtain the negative pressure necessary to hold the web against the lower surface of the endless belt 110. The suction chamber 111 and its associated fan are dimensioned so that the thickness of the web 50 passing over the surface of the endless belt 110 is not less than 50% of the thickness of the web 50 directly upstream of the endless belt, and preferably not less than 75% of its thickness directly upstream of endless the belt, and more preferably not less than 90%, and even more preferably substantially equal to the thickness directly upstream of the endless belt and still more preferably equal to its thickness directly upstream of the endless belt 110. In particular the suction chamber 111 is arranged to create, for a web area density of between 20 and 100 g/m$^2$, in particular between 30 and 80 g/m$^2$, a negative pressure of between 10 millibars and 100 millibars, and in particular between 40 and 70 millibars.

On leaving belt 100, the web 50 comes into contact with the lower surface of the endless belt 110 and is moved along this surface towards the cross-lapper input belt 70.

The space between the endless belt 110 and belt 100 or roller 30 is greater than the thickness of the web 50, so that no pinching force is applied to the web 50 in this space. In particular, this space may between 5 and 20 mm, for example between 7 and 15 mm for a web area density of between 10 and 50 g/m$^2$, and preferably between 20 and 40 g/m$^2$.

The space between the endless belt 110 and belt 70 or the roller 80 is greater than the thickness of the web 90, so that no pinching force is applied to the web 90 in this space.

Figure 3:
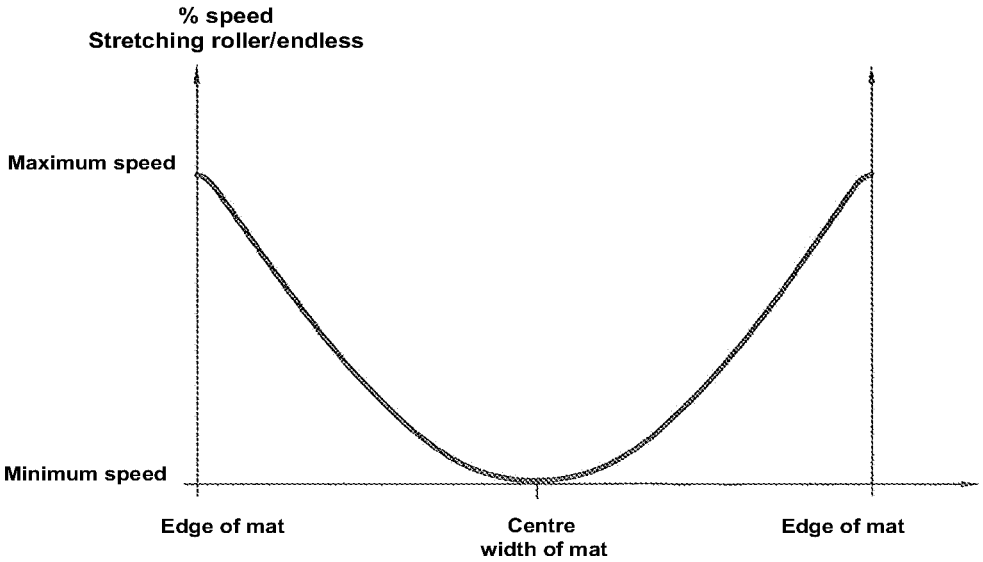
FIG. 3 shows diagrammatically the law of variation of the drafting roller speed as a function of the position of the cross-lapper carriage against the lapping width of the webs deposited.

FIG. 3 shows a curve giving the speed variation of the rollers 10, 10', 10" respectively of the endless belt 110, with respect to the speed of the output belts 1 and 2, and belts 1', 1" respectively, 100 as a percentage, the minimum speed corresponding to 100% of the speed of belts 1 and 2 respectively, belts 1', 1", 100 and the maximum speed being preferably between 140% and 160% of the speed of belts 1 and 2, belts compared with 1',1", 100 as a function of the expected transverse position in the final mat of the stretched section at time t, the speed variation thus being cyclical with a period corresponding to passage from one edge to the other (forwards and backwards) of the cross-lapper lapping carriage. This periodic speed profile (FIG. 3 shows a single cycle) produces a fibre web with a uniform, or substantially uniform transverse thickness profile, that is to say a profile whose relative thickness variation from one edge to the other is not greater than 20%, and preferably not greater than 15%, and even more preferably not greater than 10%, and highly preferably not greater than 5%, and in particular not greater than 3%, or even 1%.

If on the other hand it is desired to obtain a non-uniform profile, a speed variation cycle suited to the desired profile can be produced by varying the drafting, always keeping it between the extremes of 100% and 160%, but according to a different curve than that shown in FIG. 3.

According to the second aspect of the present invention, the use of suction at the drafting component avoids pinching the web to hold it during drafting and thereby eliminates the harmful effects of pinching on the final mat. However, it goes without saying that the present invention also envisages methods of realisation in which one or more pinch points are provided, combined with suction. The quality of the mat obtained in this way will obviously be diminished, but will still be higher than if no suction were provided. In particular, a method of realisation can be envisaged in which, in addition to suction, one or more pinch points could be provided, as in the prior art, but which would, because suction is provided, exert less force and thus have less marking effect on the web. One or more auxiliary suction points could also be provided in the path.

In addition, it is obvious that the different methods of realisation described in the figures may be combined, and in particular one characteristic provided among others may be incorporated in each of the other methods of realisation described without having to incorporate it in this new method of realisation, consisting in the combination of one of the said other methods of realisation and the characteristic thus incorporated, would only be one out of all the other characteristics of the method of realisation from where the said characteristic was drawn.

Thus, for example, the auxiliary suction described in FIG. 4 could be added to the methods of realisation in FIGS. 1, 2 and 5. According to another example, two card output belts as provided and shown in FIG. 1 could be added to the methods of realisation of FIGS. 2, 4 and 5.

The invention claimed is:

1. An apparatus for forming a fibre mat, comprising:

a fibre web-forming device configured to form two fibre webs, a cross-lapper, and a drafting device disposed between the fibre web-forming device and the cross-lapper and being configured for drafting said two fibre webs to adjust a pre-determined profile of the fibre mat when leaving the cross-lapper, said drafting device comprising a drafting roller, the fibre web-forming device comprising two output belts, each of the two output belts being at a distance from said drafting roller and being configured to output a respective one of the two fibre webs at a respective output belt guide roller, the cross-lapper having one input belt configured for receiving the two fibre webs when leaving said two output belts of the fibre web-forming device, wherein each of the two fibre webs, between a respective one of the two output belts of the fibre web-forming device and the drafting roller, is configured to be convex on one side of a point where a respective one of the two fibre webs crosses an imaginary straight line extending between a centre point of the drafting roller and a centre point of the respective output belt guide roller, and is configured to be concave on another side of the point where said respective one of the two fibre webs crosses said imaginary straight line.

* * * * *